US007140946B1

(12) United States Patent
Marlin

(10) Patent No.: US 7,140,946 B1
(45) Date of Patent: Nov. 28, 2006

(54) FLEXIBLE COILED LASSO TOY

(76) Inventor: Michael F Marlin, 6516 Monona Dr., #207, Madison, WI (US) 53718

( * ) Notice: Subject to any disclaimer, the term of this patent is extended or adjusted under 35 U.S.C. 154(b) by 0 days.

(21) Appl. No.: 09/704,771

(22) Filed: Nov. 3, 2000

(51) Int. Cl.
*A63H 33/00* (2006.01)

(52) U.S. Cl. ..... 446/486; 446/26; 446/491

(58) Field of Classification Search ..... 446/486, 446/26, 27, 28, 490, 491; 2/170; 267/167, 267/180
See application file for complete search history.

(56) References Cited

U.S. PATENT DOCUMENTS

| | | | | | |
|---|---|---|---|---|---|
| 1,566,192 | A | * | 12/1925 | Forrest | |
| 1,718,792 | A | | 6/1929 | Main | |
| 2,200,102 | A | * | 5/1940 | Sepe | 223/24 |
| 2,242,912 | A | * | 5/1941 | Healy | |
| 2,464,665 | A | * | 3/1949 | Anderson | |
| 2,630,316 | A | * | 3/1953 | Foster | 267/166 |
| 2,812,125 | A | * | 11/1957 | Mercer | 224/103 |
| 3,098,316 | A | * | 7/1963 | MCCarthy | |
| 3,176,431 | A | * | 4/1965 | Richardson | |
| 3,216,725 | A | * | 11/1965 | Hing | |
| 3,484,979 | A | * | 12/1969 | Wonsch | 43/20 |
| 3,703,292 | A | * | 11/1972 | Starr | 273/330 |
| 3,893,605 | A | * | 7/1975 | Mew | 224/103 |
| 3,908,875 | A | * | 9/1975 | Wison et al. | |
| 4,078,330 | A | * | 3/1978 | Roth | |
| 4,114,306 | A | * | 9/1978 | Molenaar | |
| 4,219,959 | A | | 9/1980 | Fleischer | |
| 4,688,564 | A | * | 8/1987 | Kelly | 128/878 |
| 4,702,474 | A | * | 10/1987 | Guibert | 482/93 |
| 4,827,661 | A | * | 5/1989 | Wendler | 43/55 |
| 4,830,244 | A | * | 5/1989 | Brannon | 224/103 |
| 4,957,300 | A | | 9/1990 | Storry | |
| 4,960,231 | A | * | 10/1990 | Popovich | 224/103 |
| 5,167,226 | A | * | 12/1992 | Laroche et al. | 601/70 |
| D361,603 | S | * | 8/1995 | Bidwell | D21/468 |
| 5,857,217 | A | | 1/1999 | Hsueh | |
| 6,000,103 | A | * | 12/1999 | Paice et al. | 24/10 R |
| 6,427,374 | B1 | * | 8/2002 | Vaiani | 42/85 |

FOREIGN PATENT DOCUMENTS

| | | | |
|---|---|---|---|
| GB | 2399017 | A * | 9/2004 |

* cited by examiner

*Primary Examiner*—Bena Miller
(74) *Attorney, Agent, or Firm*—Jonathan Grant; Grant Patent Services

(57) ABSTRACT

The present invention discloses a retractable coiled toy, made of a material having a memory, which has a handle integral with the coil or body of the toy. The slinger is preferably made out of polyurethane, a coiled steel, other plastics or some other material which has memory. The present invention discloses a number of methods for using the coiled toy. The Slinger can be used to wrap around the wrist, like a bracelet. In another use, the slinger may be used as a lasso.

5 Claims, 6 Drawing Sheets

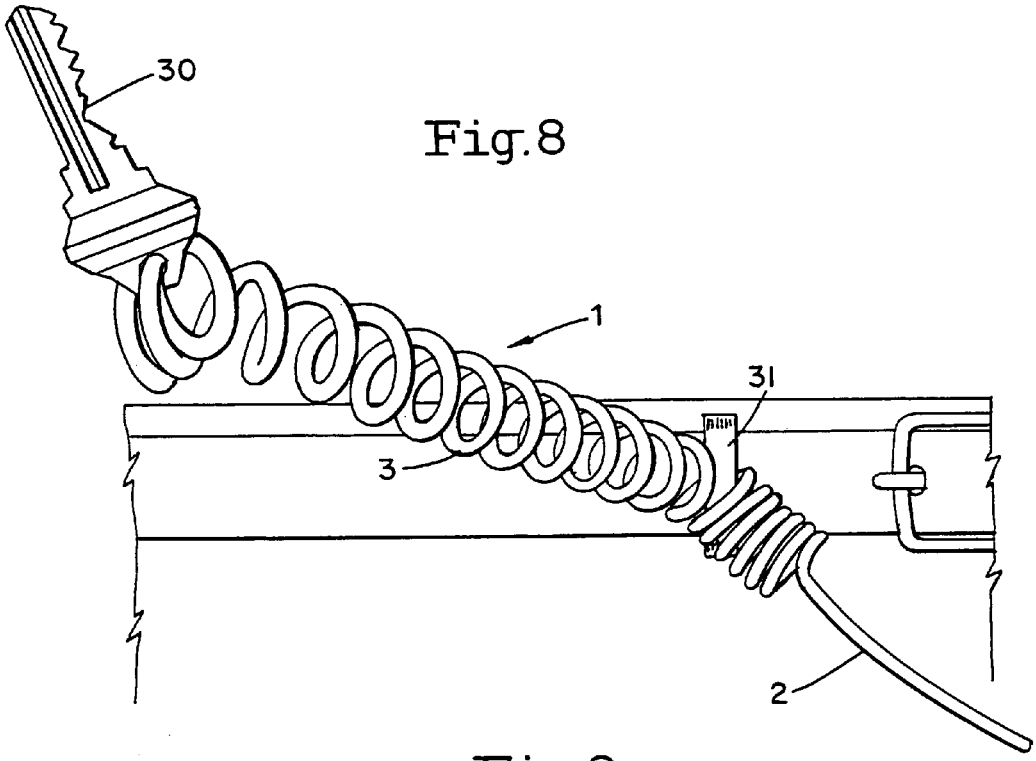
Fig.8
Fig.9
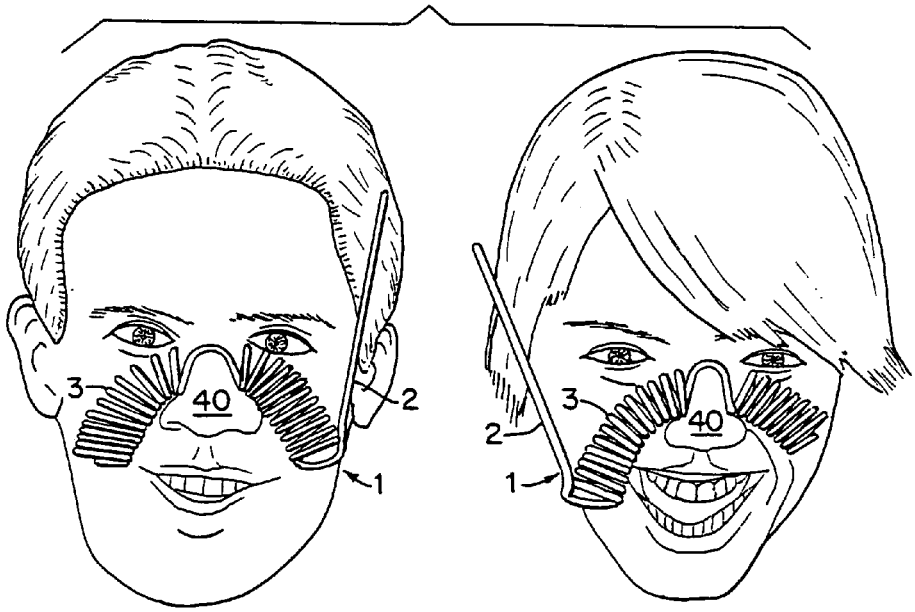

FLEXIBLE COILED LASSO TOY

BACKGROUND OF THE INVENTION

1. Field of the Invention

The present invention discloses a flexible toy having multiple functions, which can be used to perform a number of tricks.

2. Description of the Prior Art

Over the years, a number of toys have been invented which have a flexible feature.

U.S. Pat. No. 1,718,792 (F. G. Main) discloses a toy, including a metal strip coiled into a single plane at one end and having a handle secured to the other end thereof. The hnalde is arranged substantially tangential to the coiled portion of the strip and rests in the plane of the coiled portion. The coiled portion yields of its own weight to produce uncoiling and coiling movements upon the movement of the handle.

U.S. Pat. No. 4,219,959 (Fleischer) discloses a toy adapted for pulling, stretching, and bouncing which includes two intertwined helically cut shells. More specifically, the toy comprises a first spherical shell cut into a helix, a second spherical shell cut into a helix, and wherein the two helixes are intertwined with each other so as to produce an unitary toy. The two shells may be both cut in either a clockwise or counterwise direction. Alternatively, one shell may be cut in a clockwise direction, and the other shell is cut in a counterclockwise direction. Each spherical shell has a diameter of between ½ and 2½ inches. The thickness of the helix may be between ⅛ and ½ inches.

U.S. Pat. No. 4,957,300 (Storry) discloses a recreational projectile, which in one embodiment displays rotational motion imparted when the projectile is thrown, similar to the motion of a turning screw. The recreactional projectile comprises a strip of resilient plastic coiled into a compressible helix at an angle of helical advancement sufficient to prevent adjacent windings of the coiled strip from overlapping each other when in an uncompressed state.

U.S. Pat. No. 5,857,217 (Hsueh) discloses alight reflection band device having a protection band, a flexible plate disposed on the protection band, a base band disposed on the flexible plate, a transparent layer disposed on the base band, and a liquid solution and a large number of light-reflection particles disposed between the transparent layer and base band. A periphery of the protection band, a periphery of the flexible plate, a periphery of the base band, and a periphery of the transparent layer are melted together. The object of the present invention is to provide a light reflection band device which can reflect light at night. Another object of the present invention is to provide a light reflection band device which can be placed on a wrist or a waist of the user.

SUMMARY OF THE INVENTION

The present invention discloses a retractable coiled toy, hereinafter referred to as the Slinger, made of a material having a memory, which further has a handle integral with the coil or body of the toy. In a preferred embodiment of the invention, the slinger is made out of polyurethane, a coiled steel, other plastics or some other material which has memory.

The present invention discloses a number of methods for using the coiled toy. The Slinger can be used to wrap around the wrist, like a bracelet.

In another use, the slinger may be used as a lasso. In yet another use of the slinger,

BRIEF DESCRIPTION OF THE DRAWINGS

The invention will be better understood and further objects, characterizing features, details and advantages thereof will appear more clearly as the following description proceeds with reference to the accompanying diagrammatic drawings given by way of non limiting example only illustrating a presently preferred specific embodiment of the invention and wherein

FIG. 8 is a view of the slinger being used as a key ring;

FIG. 9 is a view of the slinger being used as a nose ornament;

DETAILED DESCRIPTION OF THE INVENTION

Figure 1:
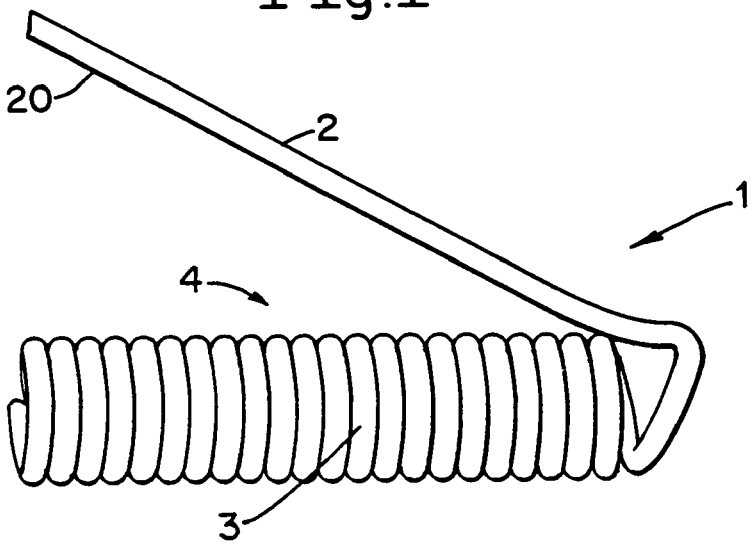
FIG. 1 is a perspective view of the slinger toy.
Figure 2:
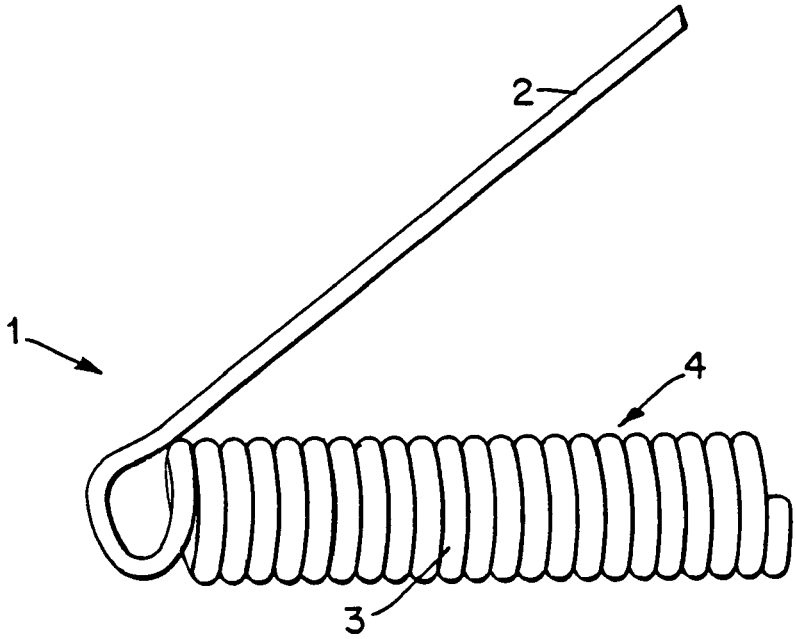
FIG. 2 is another perspective view of the slinger toy.
Figure 3:
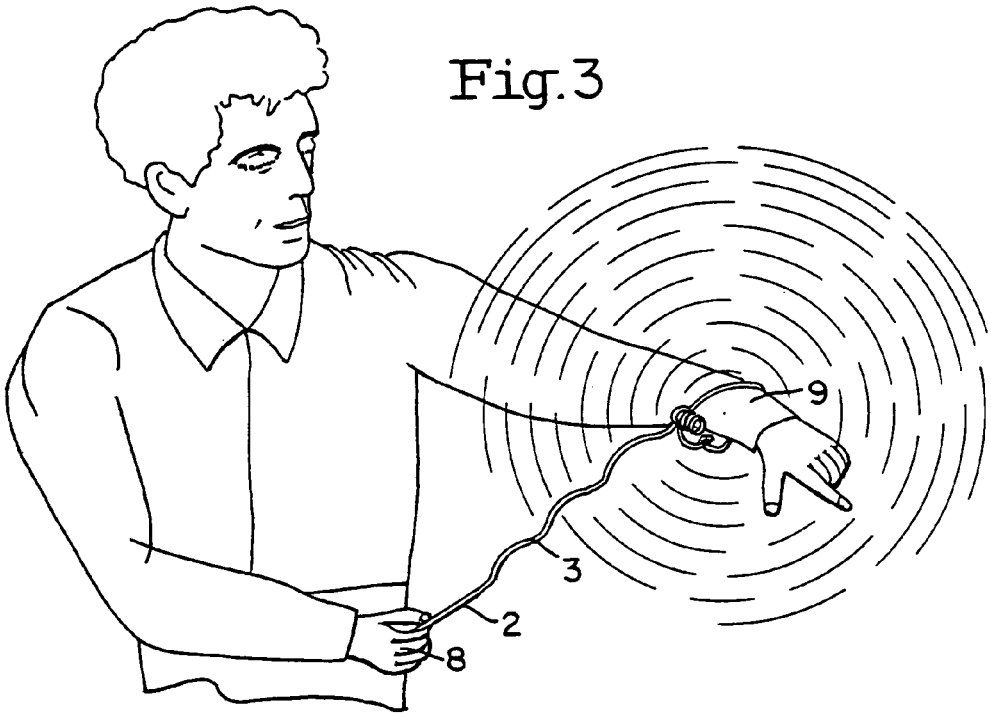
FIG. 3 is a view of the slinger being slung around an arm or wrist.
Figure 4:
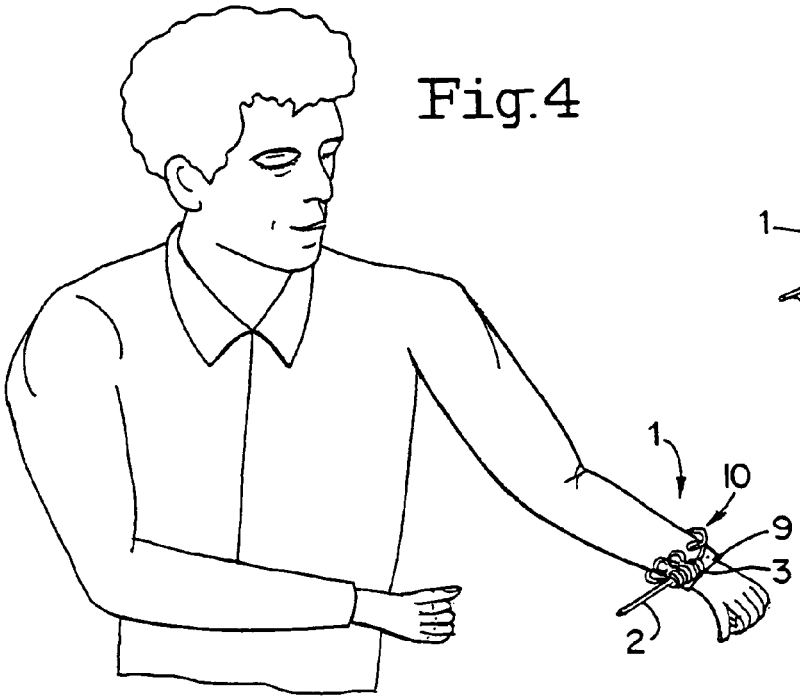
FIG. 4 is a view of the slinger after it has been slung around the wrist.
Figure 5:
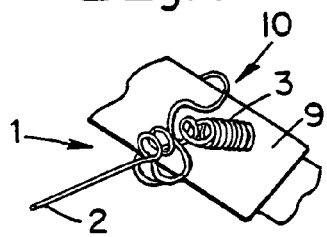
FIG. 5 is a close up view of the slinger after it has been slung around a wrist.
Figure 6:
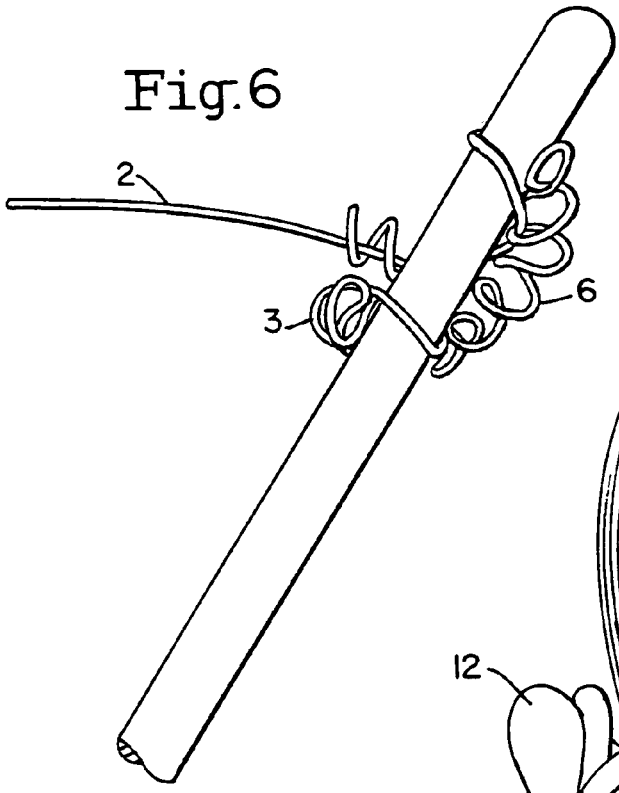
FIG. 6 is a close up view of the slinger after it has been slung around a broom handle.
Figure 7:
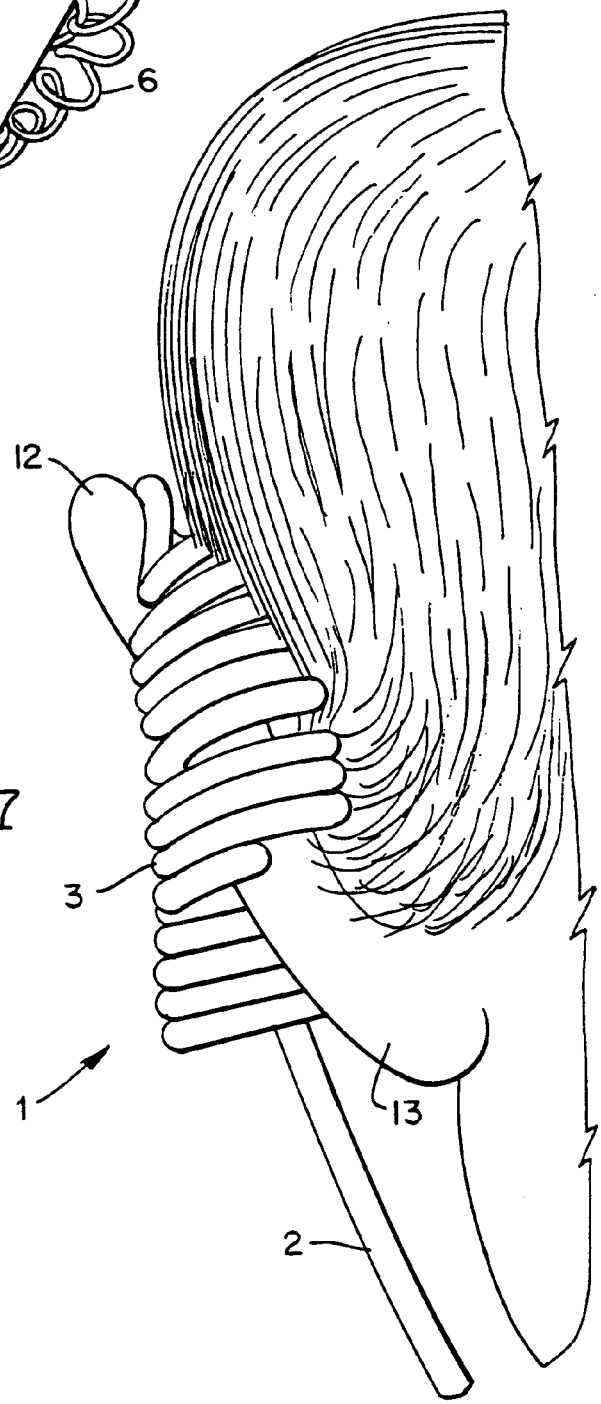
FIG. 7 is a frontal view of the slinger being used as a clothing accessory around the ear.
Figure 10:
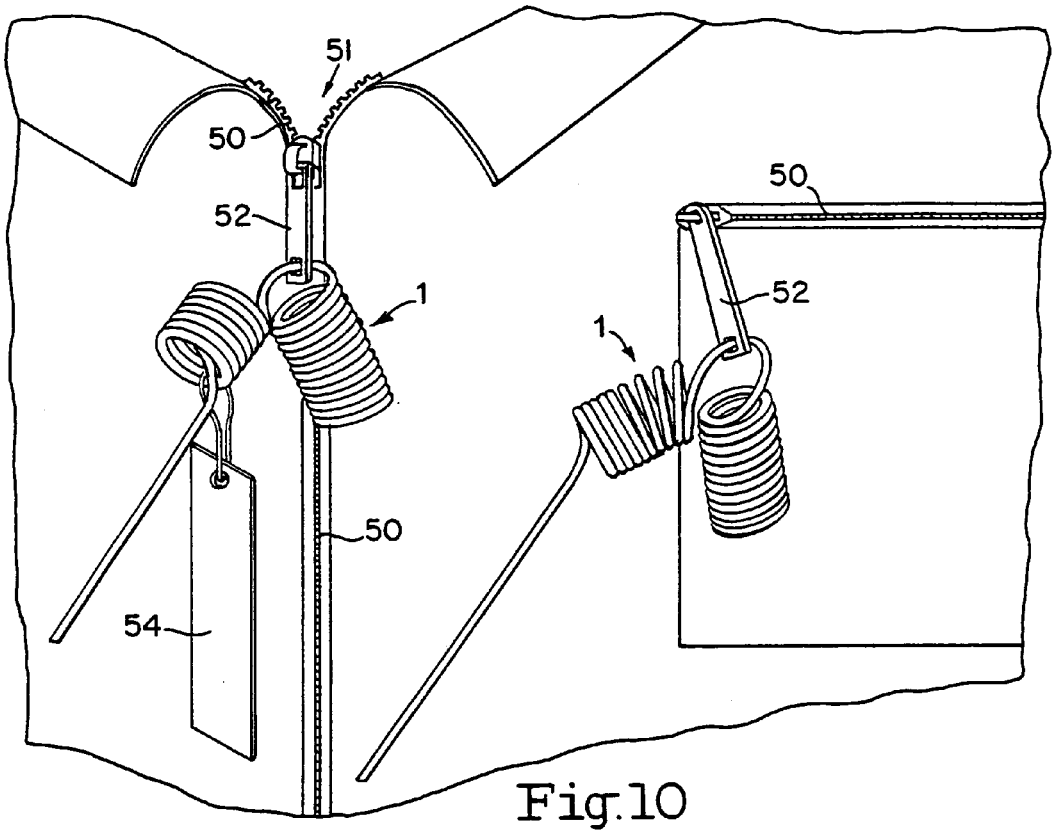
FIG. 10 is a view of the slinger toy being used as a tag holder or ornament for a zipper.
Figure 11:
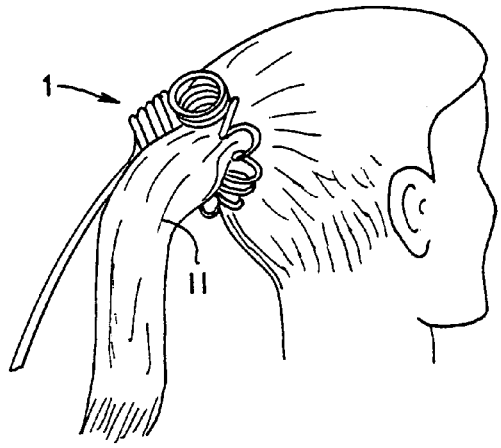
FIG. 11 is a view of the slinger toy being used as an accessory to help secure a pony tail.
Figure 12:
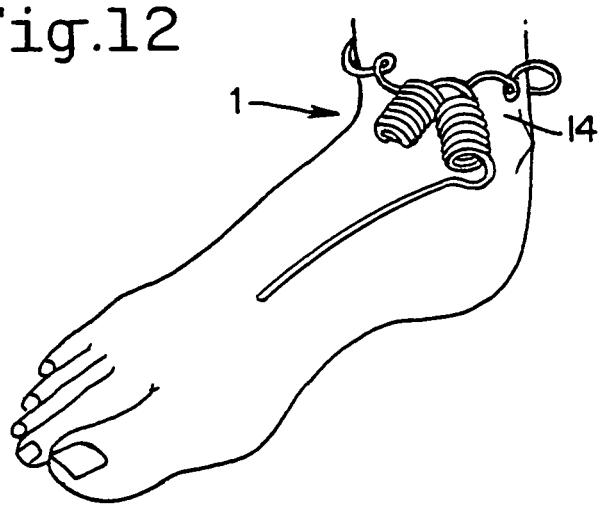
FIG. 12 is a view of the slinger toy being used as an ankle bracelet.
Figure 13:
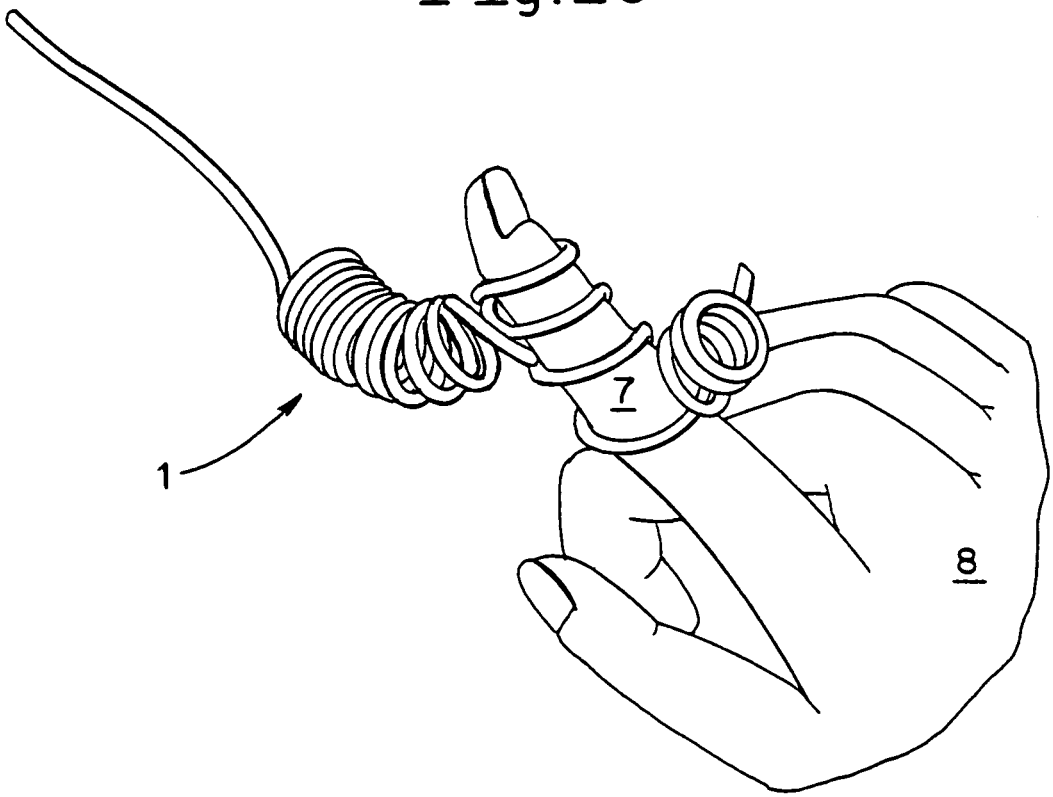
FIG. 13 is a view of the slinger toy wrapped around a finger.

Referring to the figures, the slinger toy 1 is comprised of a single, unitary piece of material. The slinger 1 is preferably made out of polyurethane, metal, or some other material having memory. The slinger 1 preferably has a handle section 2 and a coiled section 3. The coiled section 3 ranges in length from about three inches to about eight inches, with a length in the range about of 2¾ inches to about 4¾ inches being optimum. The coil 4 should range from about ¼ inch to about one inch, and preferably ⅜ inches in diameter to about ¾ inches in diameter. The handle 2, which is integral with the coiled section 3, is preferably a straight piece, preferably ranging in length from about 3½ inches to about 6½ inches. The slinger toy may come in a number of different colors, and may be flourescent. The toy may also be multi-colored. It is preferred that the colors be bright. Words or patterns may be printed along the length of the coils.

It is also preferred that the material from which the slinger toy is made is circular 20 in nature, such that if stretched out, the slinger toy would have the shape of a wire. More specifically, the material of the slinger toy has a circular width. This shape gives the toy more flexibility, and prevents the toy from scraping any of the objects it lassoes. While the material could be flat, the cir circular wire type material allows for ease of use of the toy.

The slinger toy 1 may be used in a number of different ways. In one instance, the slinger 1 may be used to catch or lasso items. This is accomplished by grasping the handle 2 with one hand, twirling the coiled section by the handle 2 so that the coiled section 3 expands outward, and then positioning the coiled section 3 such that a middle section 6 of the coiled section will wrap around the object being lassoed.

The coiled section 3 should be twirled just once, or as many times as it will take to to provide inertia.

The user of the slinger toy 1 may first try to catch his finger 7 by the slinger toy 1. The user picks up the slinger toy 1, grasps the handle 2 with one hand 8, twirls the coiled section 3 by the handle 5 so that the coiled section 3 expands outward, and then positioning the coiled section 3 such that the middle section 6 will wrap around the object being lassoed. For example, a wrist 9 may be placed in the path of the coiled section 3 being twirled, such that when coiled section 3 connects with said wrist, said retractable coiled toy 1 forms a bracelet 10 about said wrist 9. The wrist 9 is placed in the path of the rectractable coiled toy 1 being twirled, such that when said coiled section 3 connects with the wrist 9, said retractable coiled toy 1 forms a bracelet 10 about the wrist 9.

The handle 2 is positioned angularly to the coiled section 3 as the coiled section 3 wraps around said object being lassoed, such that the coil section 3 is locked in around the object being lassoed by intertwining with itself. The retractable coiled toy can also be used to capture items in the air, by using the same method as described above.

The retractable coiled toy can also be used as a fashion accessory. This is accomplished by grasping the retractable coiled toy, separating at least some coils of the coiled section; and placing the coiled section about a body part or an article of clothing. The slinger toy may be used as a key ring, with the key 30 looped through one end of the slinger toy so that the key 30 resides on the coil, while the other end of the slinger 1 is secured about a belt loop 31 or some other appropriate apparel, such that the slinger toy is attached to the clothes. The slinger toy 1 may also be attached to a zipper 50, by sliding the coil material through the opening 51 in the handle 52 of the zipper 50. The slinger toy can then be used to hang tags 54 or sky tickets to the zipper 50. As shown in FIG. 9, the slinger can also be attached to the nose 40, by either putting the bridge of the nose between two coils, or by putting the septum of the nose between two coils. The coiled section may be wrapped around a pony tail 11, at least one ear 12 or earlobe 13 of a person to form an ear attachment, around an ankle 14 to form a ankle bracelet 15. Separation of the coils allows for the ease in positioning the slinger toy 1 onto the object or body part in question.

Many modifications and variations of the present invention are possible in light of the above teachings. It is, therefore, to be understood within the scope of the appended claims the invention may be protected otherwise than as specifically described.

What is claimed is:

1. A flexible, retractable coiled toy consisting of:

a single, unitary plastic wire having a circular cross section and having memory, said wire comprising:

i) a helical section, said helical section ranging in length from about two and three-quarter inches to about six inches; and ii) a handle, said handle being integral with said helical section, said handle comprising a straight section of said wire extending outwardly from said helical section wherein said handle ranges in length from about 3½ inches to about 6½ inches.

2. The flexible retractable coiled toy of claim 1, wherein said helical section ranges in length from about three inches to about four inches.

3. The flexible retractable coiled toy of claim 1, wherein said helical section has a diameter ranging from about ¼ inch in diameter to about 1 inch.

4. The flexible retractable coiled toy of claim 1, wherein said coiled toy has words printed along the length of the coils.

5. The flexible retractable coiled toy of claim 1, wherein said coiled toy is colored.

* * * * *